US009878433B2

(12) United States Patent
Roehm

(10) Patent No.: US 9,878,433 B2
(45) Date of Patent: Jan. 30, 2018

(54) POWER TOOL

(75) Inventor: Heiko Roehm, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 12/865,647

(22) PCT Filed: Oct. 16, 2008

(86) PCT No.: PCT/EP2008/063949
§ 371 (c)(1),
(2), (4) Date: Jul. 30, 2010

(87) PCT Pub. No.: WO2009/095095
PCT Pub. Date: Aug. 6, 2009

(65) Prior Publication Data

US 2011/0000691 A1 Jan. 6, 2011

(30) Foreign Application Priority Data

Jan. 30, 2008 (DE) ..... 10 2008 000 176

(51) Int. Cl.
*B25F 5/00* (2006.01)

(52) U.S. Cl.
CPC ..... *B25F 5/001* (2013.01)

(58) Field of Classification Search
CPC ..... B25F 5/001
USPC ..... 173/47, 48, 216, 217; 408/126; 475/298
See application file for complete search history.

(56) References Cited

U.S. PATENT DOCUMENTS

| | | | | |
|---|---|---|---|---|
| 4,284,109 | A * | 8/1981 | Kilmer et al. | 140/122 |
| 4,597,453 | A * | 7/1986 | Kilmer et al. | 173/171 |
| 5,339,908 | A | 8/1994 | Yokota et al. | |
| 5,711,739 | A * | 1/1998 | Hashimoto et al. | 475/254 |
| 5,967,934 | A * | 10/1999 | Ishida et al. | 475/269 |
| 6,717,080 | B1 | 4/2004 | Chan et al. | |
| 6,909,061 | B1 | 6/2005 | Jong | |
| 2008/0032848 | A1 * | 2/2008 | Ho | 475/299 |
| 2009/0098971 | A1 * | 4/2009 | Ho et al. | 475/153 |

FOREIGN PATENT DOCUMENTS

| | | |
|---|---|---|
| DE | 19754165 A1 * | 6/1999 |
| JP | 6-8151 | 1/1994 |
| JP | 9-14433 | 1/1997 |
| JP | 2007021620 A | 2/2007 |
| RU | 2 072 913 | 2/1997 |
| SU | 878184 | 10/1981 |
| SU | 944912 | 7/1982 |

* cited by examiner

*Primary Examiner* — Nathaniel Chukwurah
(74) *Attorney, Agent, or Firm* — Norton Rose Fulbright US LLP; Gerard Messina

(57) ABSTRACT

The invention relates to a power tool, in particular a hand power tool (1), comprising an electric drive motor (2) which may be operated by means of a motor switch element (8) and a gearbox (3) driven by the drive motor (2), with a first and at least one second speed. According to the invention, the motor switch element (8) is coupled to the gearbox (3) such that the same can be switched from the second speed to the first speed by means of the motor switch element (8).

38 Claims, 1 Drawing Sheet

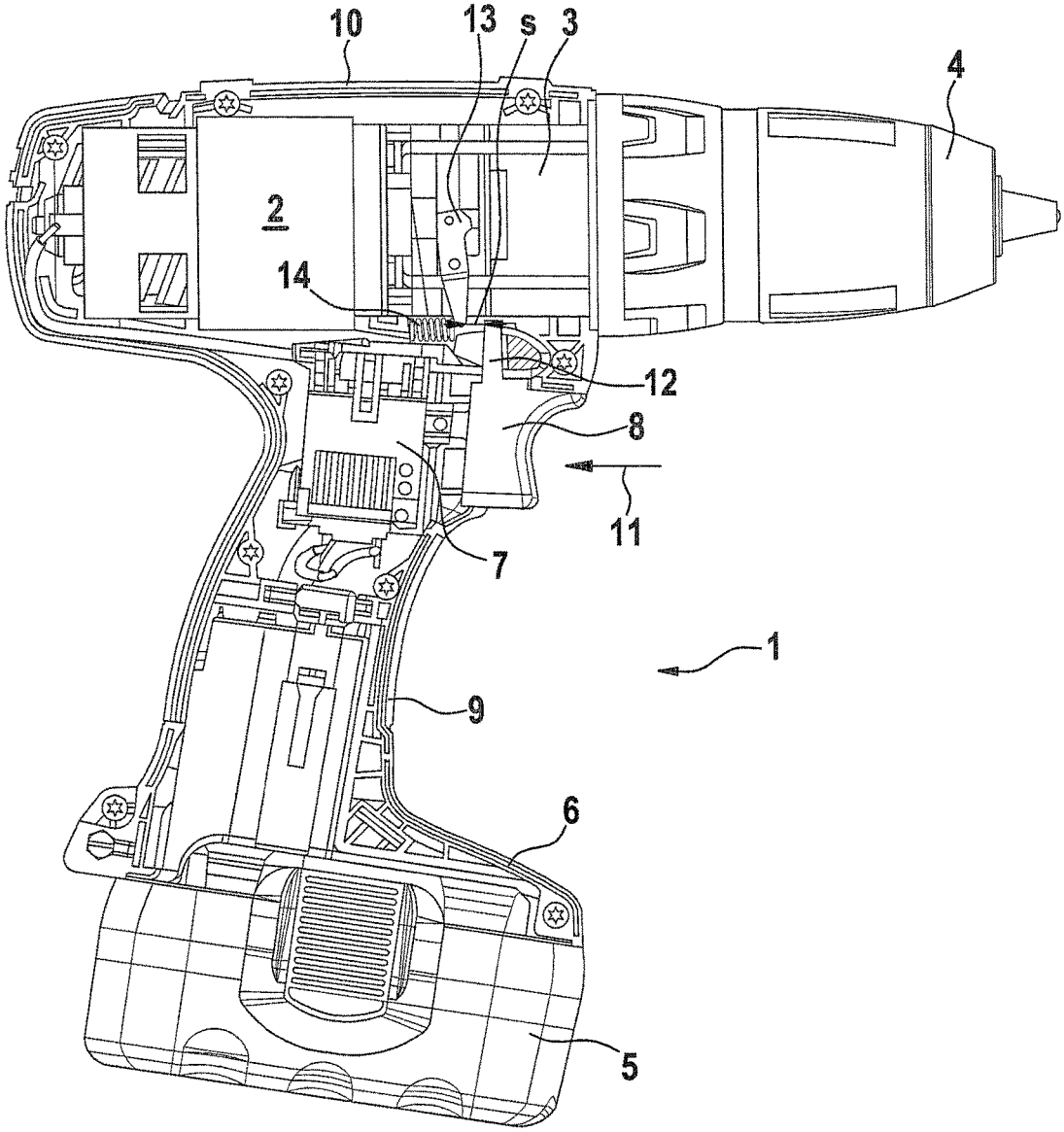
10
13
s
3
4
2
14
12
8
11
7
1
9
6
5

POWER TOOL

PRIOR ART

The invention relates to a power tool, in particular a hand-held power tool, with the defining characteristics of the preamble to claim 1.

Hand-held power tools such as (cordless) screwdrivers, (cordless) drill/drivers, or (cordless) impact drills have a shift transmission for reducing the motor speed of approximately 20,000 RPM to a working spindle speed range of approx. 150 to 2000 RPM that is reasonable for the intended use. Typically, the shift transmission of known hand-held power tools is embodied in the form of a planetary gear set equipped with two or more gears, permitting the operator to select between at least one fast second gear with a low torque and a slow first gear with a high torque.

If it is necessary to shift between the gears of the shift transmission during a work procedure, for example a screw-driving procedure, then the operator must interrupt the work procedure by releasing a motor switch element (pushbutton switch) after which the operator can use a separate gear switch to shift between the gears of the transmission. Then, the operator can actuate the motor switch element again to continue the work procedure with the newly selected transmission ratio. The shifting between gears is disadvantageously complicated and time-consuming. Having to completely interrupt the work procedure in order to shift between two gears has proven to be particularly disadvantageous.

DISCLOSURE OF THE INVENTION

Technical Object

The object of the invention, therefore, is to propose a power tool, in particular a hand-held power tool, in which the gear shifting can be carried out quickly and easily, in particular without having to interrupt a work procedure that has already begun.

Technical Attainment

This object is attained by means of a power tool with the defining characteristics of claim 1. Advantageous modifications of the invention are disclosed in the dependent claims. All combinations of at least two defining characteristics disclosed in the description, the claims, and/or the figures fall within the scope of the present invention.

The invention is based on the concept of having a motor switch element (control element)—which an operator can actuate directly in order to activate the electric drive motor—be coupled, in particular mechanically, to the shift transmission, in particular a shifting mechanism of the shift transmission, which is preferably embodied in the form of a planetary gear set, with the motor switch element and the shift transmission being coupled in a way that makes it possible to shift the shift transmission between at least two gears by actuating the motor switch element. On the one hand, this makes it possible to shift between two transmission gear ratios without having to actuate a separate control element in order to do so. It is even possible to shift between at least two gears of the shift transmission without having to interrupt an already begun work procedure (in particular drilling or screw driving) in order to do so. Preferably, the motor switch element (control element) is coupled to the shift transmission in such a way that the shifting between two gears only occurs after a predetermined movement distance has been traveled. This makes it possible to activate and deactivate the drive motor by means of the motor switch in a known way, without executing a shift. For example, a motor switch—which is associated with the motor switch element and can be actuated by the motor switch element—can be an exclusively on-off switch for opening and closing the electric circuit of the motor. Alternatively, the motor switch can be equipped with a motor speed adjusting function so that the motor speed can be adjusted in particular by means of the travel distance (movement distance) of the motor switch element. In addition to the simplified, rapid shifting between at least two gears, the invention makes it possible, if necessary, to eliminate a gear-shifting element (additional control element) that is separate from the motor switch element, making it possible to minimize the width across corners of the power tool. As will be explained in greater detail below, in addition to the above-described motor switch element with which it is possible to shift between at least two gears of the shift transmission, it is alternatively possible to provide a separate gear-shifting element or to convert the separate gear-shifting element into an on-off switch (main power switch) for the power tool.

In a particularly advantageous embodiment, the motor switch element can be used not only to shift from a second gear into a first gear, but also to execute the shift in the opposite direction—in other words, the shift transmission can be shifted from the first gear back into the second gear. Preferably, this "shifting back" occurs automatically, as explained in greater detail below, when there is a reduction in the manual actuating force that the operator is exerting on the motor switch element in order to actuate the motor switch element.

In a particularly advantageous embodiment, the gear ratio between the first gear and second gear is selected so that with the first gear, a lower speed and a higher torque can be achieved than with the second gear; it is also possible to implement a gear ratio allocation that is the reverse of this. In the case of a very slow embodiment of the first gear, it is possible to achieve power tools that are lighter-weight and more compact by using smaller (lower powered) electric drive motors for the same performance.

Particularly for applications in which the power tool, in particular the hand-held power tool, is to be used for executing screw-driving procedures, it is preferable if the first, slower gear is able to transmit an increased torque. With a transmission allocation of this kind, an operator can actuate the motor switch element to begin a screw-driving procedure in the second gear at a higher speed and lower torque and then, through an additional actuation of the motor switch element toward the end of the screw-driving procedure, the operator can shift from the second gear into the first gear with which the screw-driving procedure is then carried through to completion at a higher torque. Previously, the operator either had to execute the entire screw-driving procedure in the slow first gear or had to interrupt the screw-driving procedure in order to shift from the second gear into the first gear toward the end of the screw-driving procedure.

In a particularly advantageous embodiment, the motor switch element is embodied in the form of a trigger switch, in particular a pushbutton switch. In this case, the trigger switch is preferably coupled directly to a shifting mechanism of the shift transmission, particularly in such a way that after the trigger switch travels a defined travel distance, a shift is executed between two gears, preferably from the second gear into the first gear.

In a particularly advantageous embodiment, before the shifting action is triggered, the motor switch element is met with an increased travel resistance that the operator must overcome in order to execute the shift between the gears. This makes it possible to easily avoid an inadvertent shifting between two transmission ratios. It is also conceivable for the motor switch element to meet with a plurality of different travel resistances over the course of its travel distance. Such an embodiment is particularly useful if a plurality of shifting procedures can be achieved by means of only one actuating procedure.

In a modification of the invention, the increased travel resistance that the operator must overcome is advantageously produced by means of at least one spring that is embodied and positioned to act in opposition to the shifting procedure from the second gear into the first gear.

In a particularly advantageous embodiment, the spring that increases the travel resistance acts on the motor switch element in such a way as to reverse an executed gear shift. In other words, in order to shift from the second gear into the first gear, the motor switch element is preferably moved in opposition to the spring force of the spring so that after an operator subsequently reduces the actuating force, the spring moves the motor switch element and/or acts on the shift transmission in a way that shifts the shift transmission from the first gear into the second gear. Preferably, the motor switch element is returned to its original switch position before the gear shift was executed.

In a particularly preferable embodiment, the motor switch element is mechanically coupled to a shifting mechanism of the shift transmission, in particular to a lever—preferably embodied in the form of a pivoting lever—of the shifting mechanism. Preferably, a spring that increases the travel resistance acts directly on this lever, which in turn exerts a restoring force on the motor switch element.

As mentioned at the beginning, an embodiment can be implemented in which in addition to the motor switch element that permits a shifting of gears, a separate gear-shifting element (additional control element) is provided. This gear-shifting element is preferably subordinate to the motor switch element with regard to the gear-shifting function. In other words, in a preferable embodiment, despite the gear-shifting element having been manually placed into the second gear, the motor switch element can be used to execute a shift into the first gear, particularly toward the end of the travel distance (movement distance).

BRIEF DESCRIPTION OF THE DRAWINGS

Other advantages, defining characteristics, and details of the invention ensue from the following description of a preferred exemplary embodiment and the drawings.

The sole FIGURE shows a sectional view of a hand-held power tool embodied in the form of a cordless screwdriver.

EMBODIMENT OF THE INVENTION

FIG. 1 shows a hand-held power tool 1 embodied in the form of a cordless screwdriver. It includes an electric drive motor 2 that is connected in a torque-transmitting fashion to a two-stage shift transmission 3 embodied in the form of a planetary gear set. The shift transmission 3 in turn drives a working spindle, not shown, that actuates a tool holder 4 in rotary fashion. Depending on the intended use, the tool holder 4 can be embodied, for example, in the form of a drill chuck or a polygonal socket, in particular a hexagonal socket.

To supply the drive motor 2 with electrical energy, a replaceable battery pack 5 is provided, which is embodied in the form of a tool base and can be fastened to a plastic housing 6 of the hand-held power tool 1.

To activate the electric drive motor 2, i.e. to supply the drive motor 2 with electrical energy from the battery pack 5, a motor power switch 7 is provided, which can be embodied as an exclusively on-off switch or if necessary, as a speed adjusting switch, for example through integration of a variable electrical resistance. The motor power switch 7 can be actuated by means of a motor switch element 8 embodied in the form of a trigger switch element. The motor switch element 8 is situated in an upper region of a handle 9, whose lower end supports the battery pack 5 and whose upper end in the plane of the drawing transitions into an operation housing section 10 extending essentially transversely relative to the handle 9. In an alternative embodiment (not shown), the motor switch element 8 actuates a signal generator for a set of electronics that switches the motor current and/or regulates the speed.

In the hand-held power tool 1 shown, the shift transmission 3 is in a second gear serving as a starting position, in which a higher speed, but only a lower torque for driving the tool holder 4 can be achieved as compared to the speed and torque that can be achieved in a first gear. To activate the drive motor 2, an operator must actuate the motor switch element 8 in the direction of the arrow 11, i.e. in the direction oriented into the housing 6, as a result of which the motor switch 7 supplies electrical energy to the drive motor 2. The motor switch element 8 has an integral extension 12 pointing upward in the plane of the drawing. After the motor switch element 8 has been moved into the housing 6 far enough that the extension 12 has traveled the distance s, the extension 12 then rests against a pivotably supported lever 13 of a gear-shifting mechanism of the shift transmission 3. Preferably, the motor power switch 7 is embodied in an intrinsically known fashion such that the motor current increases as the movement distance of the motor switch element 8 increases. If a shifting procedure from the second, faster gear into the first, slower gear is to be executed, the motor switch element 8 must be moved back in the direction oriented into the housing 6 so that the extension 12 travels a greater distance than the distance s shown in the drawing. With this greater movement distance, the travel resistance acting on the motor switch element 8 is greater than it is at the beginning of the movement. This can be attributed to a spring 14 embodied in the form of a helical compression spring, which presses against a free end region of the lever 13 from left to right in the plane of the drawing, i.e. essentially in the opposite direction from the arrow 11 and therefore strives either to leave the lever 13 in its original switch position (second gear) or to move it back into this position. In other words, as soon as the motor switch element 8 comes into contact with and moves the lever 13 embodied in the form of a pivoting lever, the actuating force that the operator must exert increases because it becomes additionally necessary to compress the spring 14 acting on the lever 13 in the region of its free end. If the motor switch element 8 is moved further and therefore the integral extension 12 moves the lever 13 in opposition to the spring force of the spring 14, then the shift transmission 3 is moved from the original second gear into the first gear in an intrinsically known fashion and remains in the first gear as long as the operator continues to exert a sufficient actuating force on the motor switch element 8, as a result of which despite the action of the spring force 14, the lever 13 remains in a position toward the left in the plane of the drawing, not shown.

If the operator reduces the actuating force exerted on the motor switch element 8 and this actuating force falls below the spring force of the spring 14, then the spring 14 moves the lever 13 back into its original position (shown), as a result of which the shift transmission 3 is shifted from the first gear back into the second gear.

In addition to the motor switch element 8 shown, a separate gear-shifting element can be provided if necessary, for example on the top of the operation housing section 10; such a separate gear-shifting element is preferably subordinate to the motor switch element 8 in its gear-shifting function. It is likewise conceivable, in addition to the motor switch element 8, to provide an additional main electrical switch that can be positioned, for example, in the region of the operation housing section 10 toward the top in the plane of the drawing. If a separate gear-shifting element and an additional main switch are omitted, then the width across corners of the hand-held power tool 1 shown is less than that of known hand-held power tools due to the elimination of the separate control element.

The invention claimed is:

1. A power tool, comprising:

a housing;

an electric drive motor;

a user-actuatable motor switch element moveable in a first direction for activating said electric drive motor and in an opposite direction for deactivating said electric drive motor; and a transmission that is driven by the drive motor and has a first gear and at least one second gear, wherein said motor switch element is mechanically coupled to said transmission in such a way that movement of said motor switch element in said first direction along a predefined distance activates said electric drive motor, and movement of said motor switch element along a further predefined distance in said first direction shifts said transmission from the second gear into the first gear or from the first gear into the second gear.

2. The power tool as recited in claim 1, in which the first gear is capable of transmitting a greater torque than the second gear.

3. The power tool as recited in claim 1, in which the motor switch element is embodied in the form of a trigger switch element.

4. The power tool as recited in claim 1, in which shifting from the second gear into the first gear or from said first gear into said second gear requires an increased travel resistance of said motor switch element during movement in said predefined distance to be overcome by a user force, as compared to a lesser resistance of said motor switch element during movement in said predefined distance for only activating the drive motor.

5. The power tool as recited in claim 4, in which the increased travel resistance is produced by means of at least one spring.

6. The power tool as recited in claim 5, in which after a user reduces the actuating force, the spring moves the motor switch element in such a way that the transmission is shifted from said second gear into said first gear or from the first gear into the second gear.

7. The power tool as recited in claim 5, wherein said at least one spring acts on aid lever to urge said lever in a starting position which is either the first or the second gear.

8. The power tool as recited in claim 1, in which the motor switch element is mechanically coupled to a shifting mechanism of the transmission.

9. The power tool as recited in claim 8, wherein the shifting mechanism is a lever.

10. The power tool as recited in claim 1, wherein the power tool is a hand-held power tool.

11. The power tool as recited in claim 9, wherein after activating said motor switch element and moving said motor switch element along a first segment of said predefined distance, said motor switch element contacts said lever.

12. The power tool as recited in claim 11, wherein after moving said motor switch element beyond said first segment of said predefined distance said lever is switched by means of said motor switch element from the starting position into in a switch position which corresponds to the other of said first gear or said second gear.

13. The power tool as recited in claim 1, in which a gear-shifting element that is separate from the motor switch element is provided.

14. The power tool as recited in claim 13, in which the separate gear-shifting element is subordinate to the motor switch element for shifting said transmission.

15. The power tool as recited in claim 9, wherein said lever is embodied in the form of a pivoting lever.

16. The power tool as recited in claim 1, in which the first gear is capable of transmitting a lower torque than the second gear.

17. The power tool as recited in claim 1, wherein switching said transmission back from the first gear into the second gear or from the second gear into the first gear occurs automatically upon reducing the manual actuating force exerted by the user on the motor switch element.

18. The power tool as recited in claim 1, wherein said motor switch element includes an extension.

19. A power tool, comprising:

a housing;

an electric drive motor;

a motor switch element for activating said electric drive motor; and a transmission that is driven by said electric drive motor and has at least a first gear and a second gear, wherein said motor switch element is actuated by a user force and is mechanically coupled to said transmission in such a way that movement of said motor switch element along a predefined distance activates said electric drive motor, and movement of said motor switch element along a further predefined distance shifts said transmission from the second gear with high speed and low torque into the first gear with low speed and high torque.

20. The power tool as recited in claim 19, wherein switching said transmission from the second gear into the first gear is achieved by activating said motor switch element and moving said motor switch element along a predefined distance.

21. The power tool as recited in claim 19, wherein said motor switch element is coupled to said transmission in such a way that said motor switch element is adapted to switch said transmission back from the first gear into the second gear.

22. The power tool as recited in claim 19, wherein switching said transmission back from the first gear into the second gear occurs automatically upon reducing the manual actuating force exerted by the user on the motor switch element.

23. The power tool as recited in claim 19, in which the motor switch element is embodied in the form of a trigger switch element.

24. The power tool as recited in claim 19, in which shifting from the second gear into the first gear requires an increased travel resistance of said motor switch element during movement in said first direction to be overcome by a user force, as compared to a lesser resistance of said motor switch element during movement in said first direction for only activating the drive motor.

25. The power tool as recited in claim 24, in which the increased travel resistance is produced by means of at least one spring.

26. The power tool as recited in claim 25, in which after a user reduces the actuating force, the spring moves the motor switch element in such a way that the transmission is shifted from the first gear into the second gear.

27. The power tool as recited in claim 25, wherein said at least one spring acts on said lever to urge said lever in a starting position which is either the first or the second gear.

28. The power tool as recited in claim 19, in which the motor switch element is mechanically coupled to a shifting mechanism of the transmission.

29. The power tool as recited in claim 28, wherein the shifting mechanism is a lever.

30. The power tool as recited in claim 29, wherein said lever is embodied in the form of a pivoting lever.

31. The power tool as recited in claim 29, wherein after activating said motor switch element and moving said motor switch element along a first predefined distance, said motor switch element contacts said lever.

32. The power tool as recited in claim 31, wherein after moving said motor switch element beyond said first predefined distance, said lever is switched by means of said motor switch element in a switch position which corresponds to said first gear.

33. The power tool as recited in claim 19, in which a gear-shifting element that is separate from the motor switch element is provided.

34. The power tool as recited in claim 33, in which the separate gear-shifting element is subordinate to the motor switch element for shifting said transmission.

35. The power tool as recited in claim 19, wherein the power tool is a hand-held power tool.

36. The power tool as recited in claim 19, wherein said motor switch element includes an extension.

37. The power tool as recited in claim 19, wherein the motor switch element is movable in a first direction for activating said electric drive motor and in a second direction for deactivating said electric drive motor, and the movement of said motor switch element, after activating said electric drive motor, to shift said shift transmission from the second gear with high speed and low torque into the first gear with low speed and high torque, is in said first direction.

38. A power tool, comprising:

a housing;

an electric drive motor;

a user-actuatable motor switch element to activate the electric drive motor; and a transmission that is driven by the drive motor and has at least a first gear and a second gear, wherein the motor switch element is mechanically coupled to a shift mechanism of the transmission in such a way that movement of the motor switch element along a predefined distance in a direction oriented into the housing activates the electric drive motor, and movement of the motor switch element along a further predefined distance in the direction oriented into the housing actuates the shift mechanism to shift the transmission from the second gear into the first gear or from the first gear into the second gear.

* * * * *